US012553453B2

(12) United States Patent
Lovegrove et al.

(10) Patent No.: US 12,553,453 B2
(45) Date of Patent: Feb. 17, 2026

(54) AUTOMATIC DOUBLE-BELL SIPHON

(71) Applicant: William Lovegrove, Greenville, SC (US)

(72) Inventors: William Lovegrove, Greenville, SC (US); Shane Lott, Mint Hill, NC (US); Dylan Winnberg, Southgate, MI (US)

( * ) Notice: Subject to any disclaimer, the term of this patent is extended or adjusted under 35 U.S.C. 154(b) by 91 days.

(21) Appl. No.: 18/532,659

(22) Filed: Dec. 7, 2023

(65) Prior Publication Data

US 2025/0188956 A1 Jun. 12, 2025

(51) Int. Cl.
*F04F 10/02* (2006.01)

(52) U.S. Cl.
CPC ..... *F04F 10/02* (2013.01); *Y10T 137/2822* (2015.04)

(58) Field of Classification Search
CPC ..... F04F 10/00; F04F 10/02; E03F 9/00–007; E03D 1/04; E03D 1/183; E03D 5/092; E03D 5/094; Y10T 137/2713–2924; Y10T 137/2822; Y10T 137/2849
USPC ..... 137/123–153; 4/368–377, 227.7; 119/72–81
See application file for complete search history.

(56) References Cited

U.S. PATENT DOCUMENTS 237,187 A * 2/1881 Hyde ..... E03F 5/0402 137/139
543,013 A * 7/1895 Hagen ..... E03D 1/165 137/135
649,170 A 5/1900 Land
702,066 A * 6/1902 Miller ..... F04F 10/00 137/139
753,174 A * 2/1904 Smith ..... A47L 15/4436 137/136
848,365 A * 3/1907 Harrigan ..... E03F 9/007 137/143
848,696 A * 4/1907 Shields ..... E03F 5/0402 137/143
873,961 A * 12/1907 Shields ..... E03F 5/0402 137/143
882,451 A * 3/1908 Brocke ..... F24D 11/003 137/134
969,516 A * 9/1910 Bouchayer ..... F04F 10/00 137/143
1,128,575 A * 2/1915 Berry ..... E03F 5/0402 137/143
1,129,898 A * 3/1915 Patton ..... E03D 1/165 137/247
1,190,604 A * 7/1916 Stary ..... E03F 5/0402 137/139
1,413,484 A * 4/1922 Moise ..... E03D 1/165 137/147

(Continued)

OTHER PUBLICATIONS

Bradley K. Fox et. al., "Construction of Automatic Bell Siphons for Backyard Aquaponic Systems," Biotechnology, Jun. 2010, University of Hawai'i at Mãnoa. (https://www.ctahr.hawaii.edu/oc/freepubs/pdf/BIO-10.pdf) (Year: 2010).*

*Primary Examiner* — Craig J Price

(57) ABSTRACT

A double-bell siphon for liquid flow control that improves upon existing bell siphons by the addition of an outer bell which helps the bell siphon to stop siphoning when the liquid level drops below the intended level. Optionally, a cup further enhances the ability for the siphon to stop properly.

4 Claims, 8 Drawing Sheets

(56) References Cited

U.S. PATENT DOCUMENTS

| | | | | |
|---|---|---|---|---|
| 1,822,060 | A * | 9/1931 | Powell | E03D 1/10 4/373 |
| 3,973,751 | A * | 8/1976 | Brugnoli | E03D 1/085 4/380 |
| 4,254,934 | A * | 3/1981 | Amici | E03D 1/08 4/380 |
| 4,255,361 | A * | 3/1981 | Goettl | F24F 6/04 137/143 |
| 9,565,811 | B2 | 2/2017 | Tsai | |
| 2003/0024874 | A1 * | 2/2003 | Wallace | C02F 3/00 210/150 |
| 2013/0047508 | A1 | 2/2013 | Toone | |
| 2015/0338009 | A1 * | 11/2015 | Huang | F16L 43/00 137/123 |
| 2022/0356691 | A1 | 11/2022 | Cashatt | |

* cited by examiner

AUTOMATIC DOUBLE-BELL SIPHON

TECHNICAL FIELD

A siphon moves liquid upward above the surface of a reservoir without using a pump. A bell siphon automatically starts and stops the siphoning action as the liquid level in the reservoir rises and falls. Bell siphons are used in a variety of fluid flow applications including wastewater discharge, restroom fixtures, and water flow in hydroponic and aquaponic systems.

BACKGROUND

Historically, the bell siphon has had two parts. The first is the upright, inner standpipe through which a liquid will drain out of the surrounding reservoir. The second part is the bell, which is typically a PVC pipe or a metal tube with a cap on the top, through which no liquid can escape. It also has one or more openings cut into the perimeter on the bottom so that liquid and air can flow through as it stands on the reservoir bed. When the liquid level reaches the height of the standpipe, the liquid and air flow into the standpipe creating a lower pressure inside of the bell. This causes liquid to be siphoned out of the reservoir and into the standpipe. The level drops until the liquid level reaches the level of the opening(s) at the bottom of the bell. At this point, air flows into the bell, breaking the siphon effect. The reservoir can now fill with liquid again.

Ideally, the bell siphon breaks its siphon effect every time the liquid level drops to the level of holes on the bottom. However, the air flowing into the bell may be carried by the moving liquid out the standpipe. If this occurs, the liquid level will remain at the low level in the reservoir and the siphon will never stop.

The bell siphon is a traditional way of automatically regulating liquid reservoir levels to keep a fill-drain cycle running repeatedly. For example, U.S. Pat. No. 649,170A, "Automatic Siphon," discloses an early automatic siphon design that was used for the flushing of sewers; it consists of the traditional bell and standpipe. US20220356691A1, "Underground Stormwater Storage System," discloses a similar use of a bell siphon in a stormwater storage system. US20130047508A1, "Aquaponics System" discloses a bell siphon for regulating water level in the plant bed of an aquaponics system.

However, there are disadvantages to this conventional bell siphon design in all these applications. First, if the liquid flow rate into the reservoir is too low then the bell siphon will fail to start the siphon effect. Second, if the flow of liquid is too high, the bell siphon will never stop. This range of flow rates where the siphon will both start and stop is limited.

Other attempts to provide reliable siphoning include U.S. Pat. No. 9,565,811B2, "External Cultivation liquid siphon," which implemented a U-tube shaped bell siphon in an aquaponics system. Another common addition is a small straw, also referred to as a snorkel, that runs up the side of the bell siphon external to the bell and allows an alternate path for air to enter. A cup around the snorkel provides some additional benefits, as seen in "Construction of Automatic Bell Siphons for Backyard Aquaponic Systems" by Bradley K. Fox, Robert Howerton, and Clyde S. Tamaru, University of Hawai'i at Mānoa, Department of Molecular Biosciences and Bioengineering, 2010 (https://www.ctahr.hawaii.edu/oc/freepubs/pdf/BIO-10.pdf). However, a snorkel allows only a limited amount of air to enter. A small-diameter snorkel is also susceptible to clogging.

SUMMARY

Our dual-bell siphon replaces the snorkel with a second outer bell that wraps around the entirety of the inner bell (360 degrees), providing better air intake and less chance of clogging, while also allowing a smaller overall diameter of the device. The optional surrounding cup further enhances the airflow to stop the siphon.

BRIEF DESCRIPTION OF THE DRAWINGS

FIG. 3 (PRIOR ART) is a cross section view of the traditional bell siphon. The inner standpipe's perimeter is surrounded by the bell with an annular space between.

DETAILED DESCRIPTION

Figure 1:
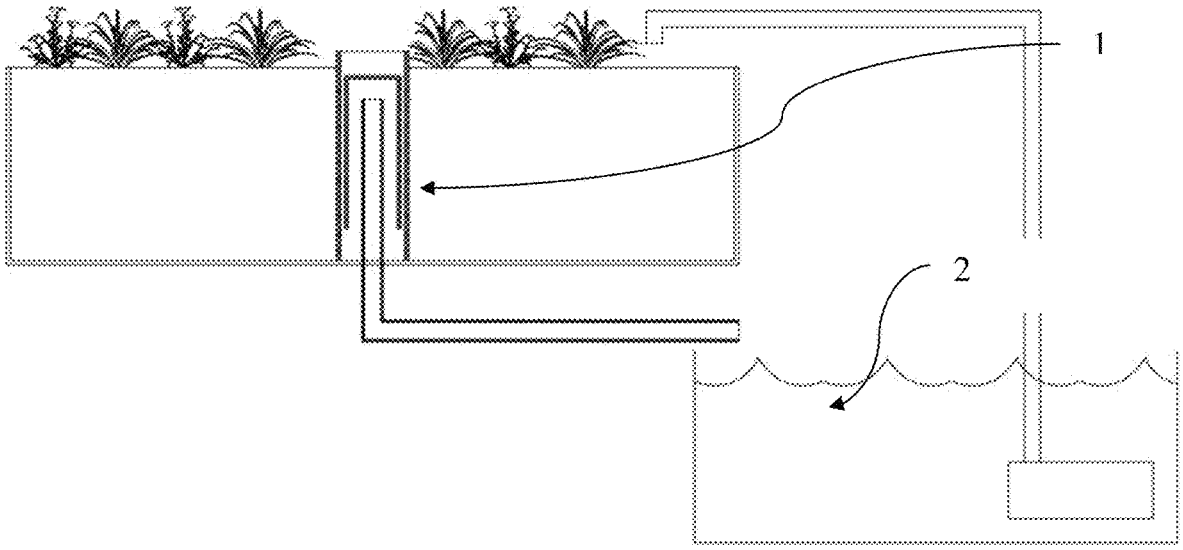
FIG. 1 PRIOR ART
FIG. 1 (PRIOR ART) shows a typical application of a bell siphon, an aquaponic system with the bell siphon in the grow bed.

FIG. 1 (PRIOR ART) shows the common bell siphon as it is used in an aquaponic grow bed, a typical application. The bell siphon automatically regulates the water level in the grow bed, causing it to rise and fall periodically. The bell siphon 1, allows water to flow through it down into the fish tank 2.

Figure 2:
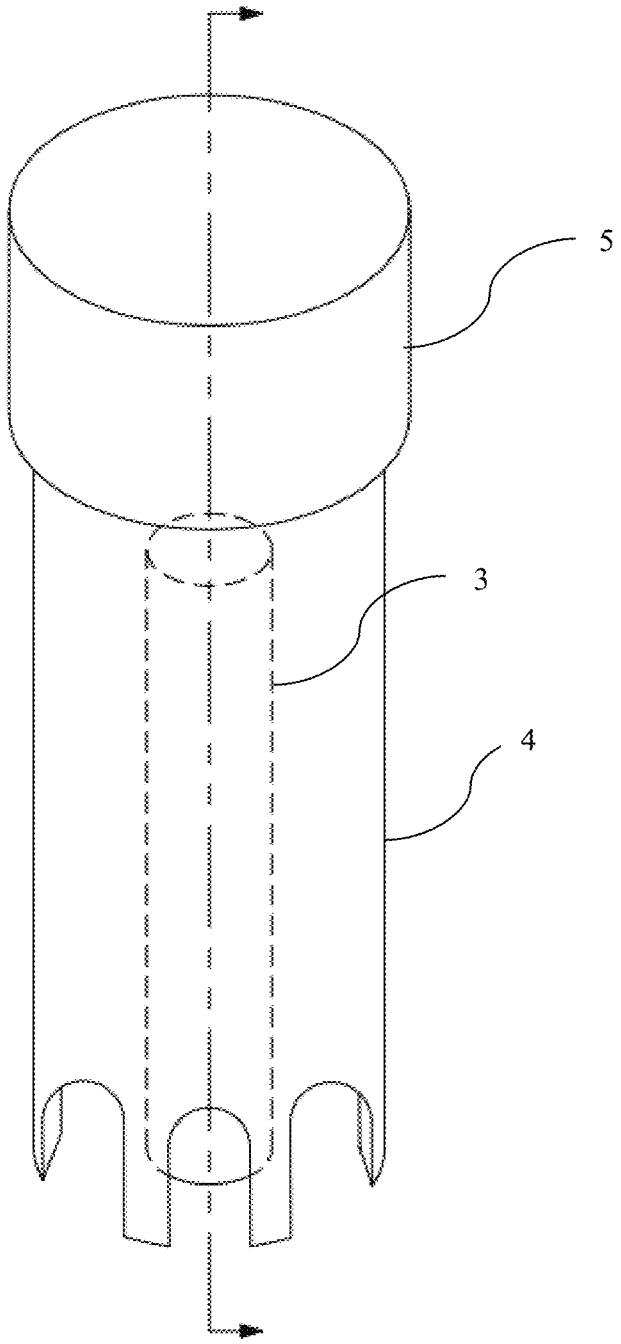
FIG. 2 PRIOR ART
FIG. 2 (PRIOR ART) is an isometric view of the traditional bell siphon.

FIG. 2 (PRIOR ART) is a depiction of the traditional bell siphon. The bell 4 has cap 5 fastened at the top. The bell 4 surrounds the standpipe 3. The cutout holes on the bottom of the bell 4 allow for air and water to enter the bell.

Figure 3:
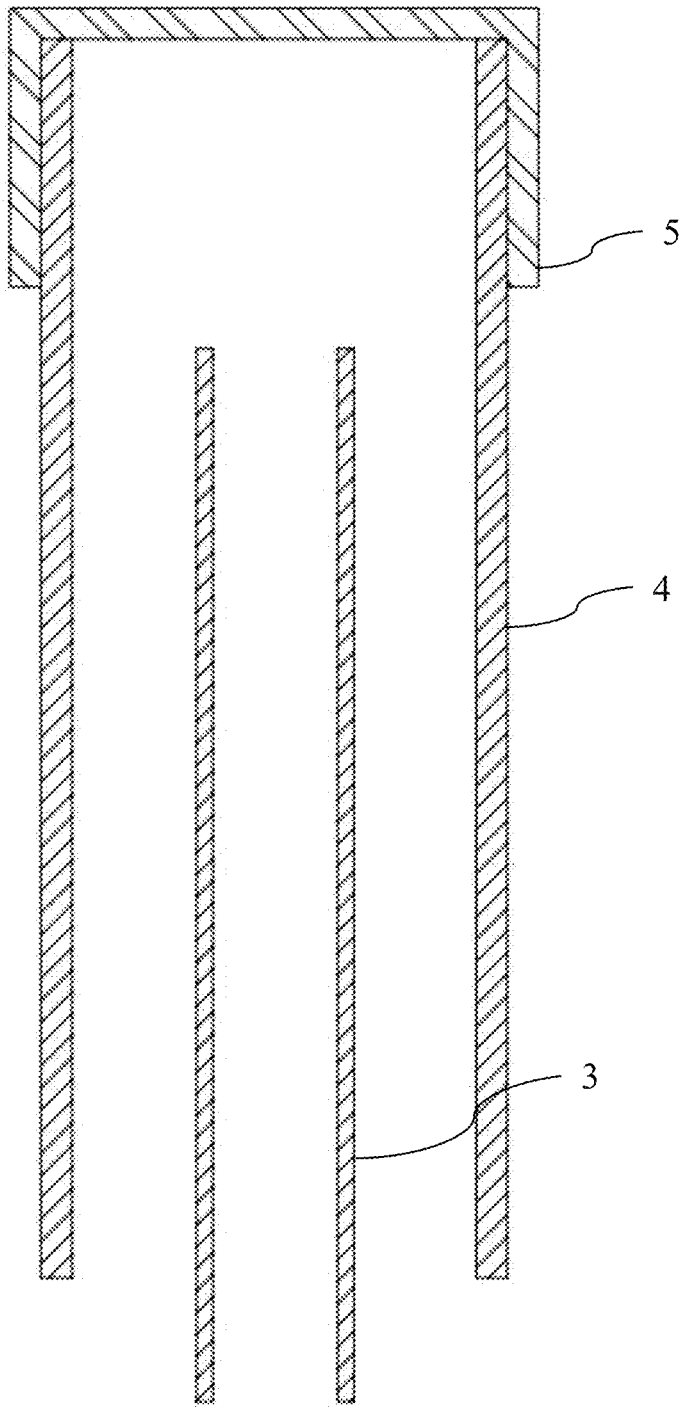
FIG. 3 PRIOR ART

FIG. 3. (PRIOR ART) depicts a cross section of the traditional bell siphon.

Figure 4:
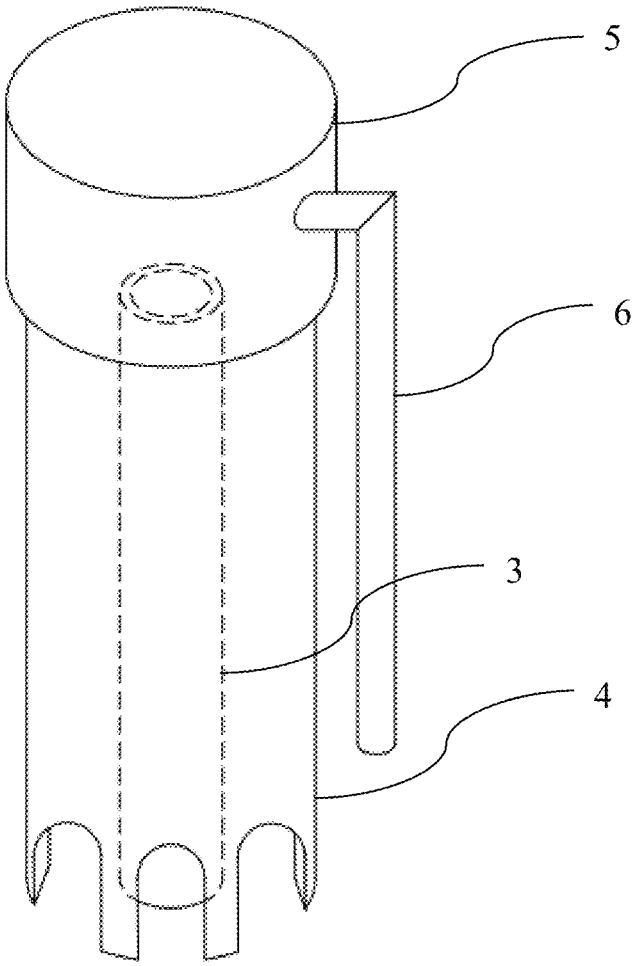
FIG. 4 PRIOR ART
FIG. 4 (PRIOR ART) depicts a bell with a snorkel tube to enhance the intake of air and the stopping of the siphon. The snorkel tip is at the level of or higher than the highest opening in the bell.

FIG. 4 (PRIOR ART) depicts a bell with a snorkel tube 6 to enhance the intake of air and the stopping of the siphon.

Figure 5:
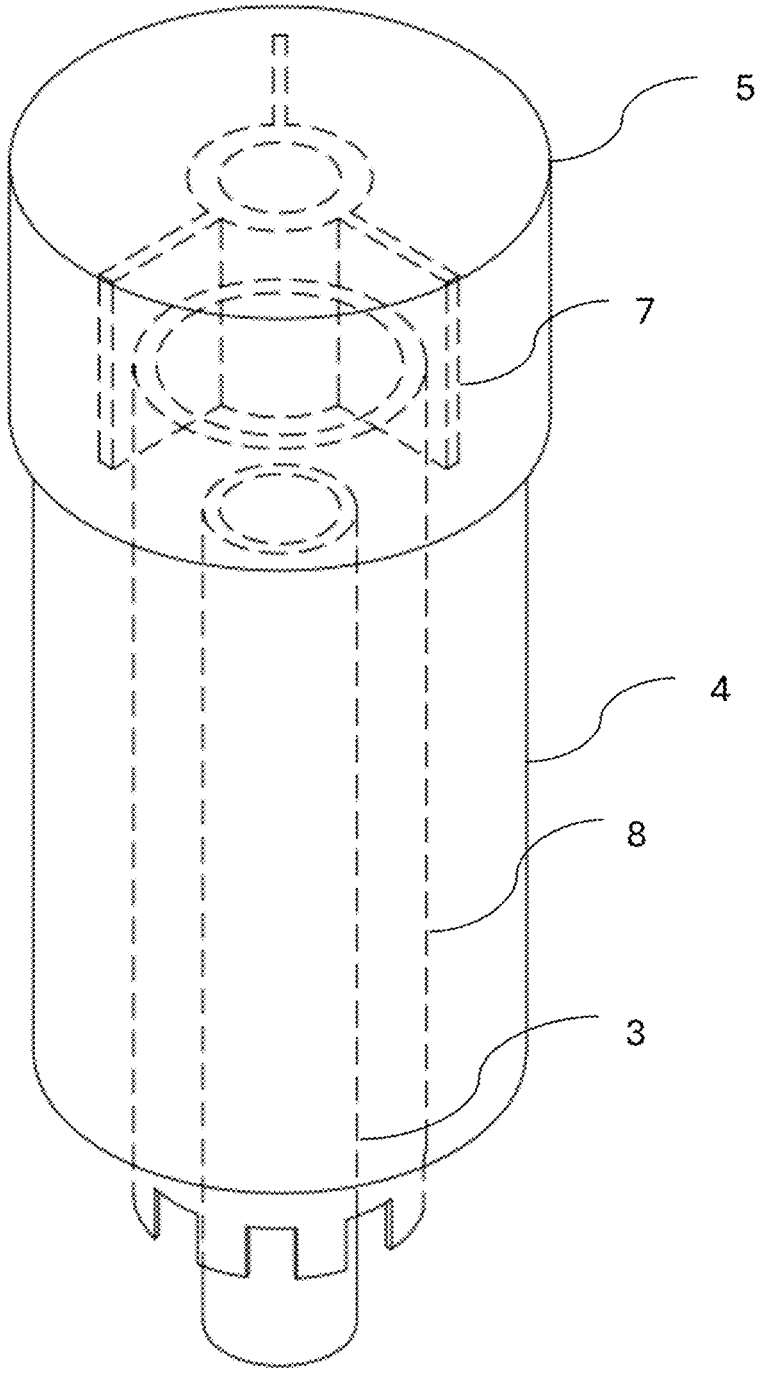
FIG. 5 is an isometric view of the double-bell siphon.

FIG. 5 is the new double-bell siphon. The added outer bell 4 has a cap 5 on the top and a 360-degree aperture for air intake at the bottom. The inner bell 8 stands on the floor of the liquid reservoir surrounding the standpipe 3. The outer bell 4 is mounted above and surrounds the inner bell 8. The bottom of the outer bell 4 is at or above the highest opening in the inner bell 8 bottom end. The outer bell 4 acts as a large snorkel and allows a large volume of air to travel up to the top of the inner bell 8. The air bubbles brought to the top of the inner bell 8 allow for a more consistent siphon break. The outer bell 4 can be mounted in a variety of ways. In our preferred embodiment we use a spacer 7 to support the outer bell 4 while allowing fluids to flow. Alternately, the outer bell 4 could sit directly on top of the inner bell 8, with openings around the perimeter of the inner bell 8 at the top to allow fluids to enter.

Figure 6:
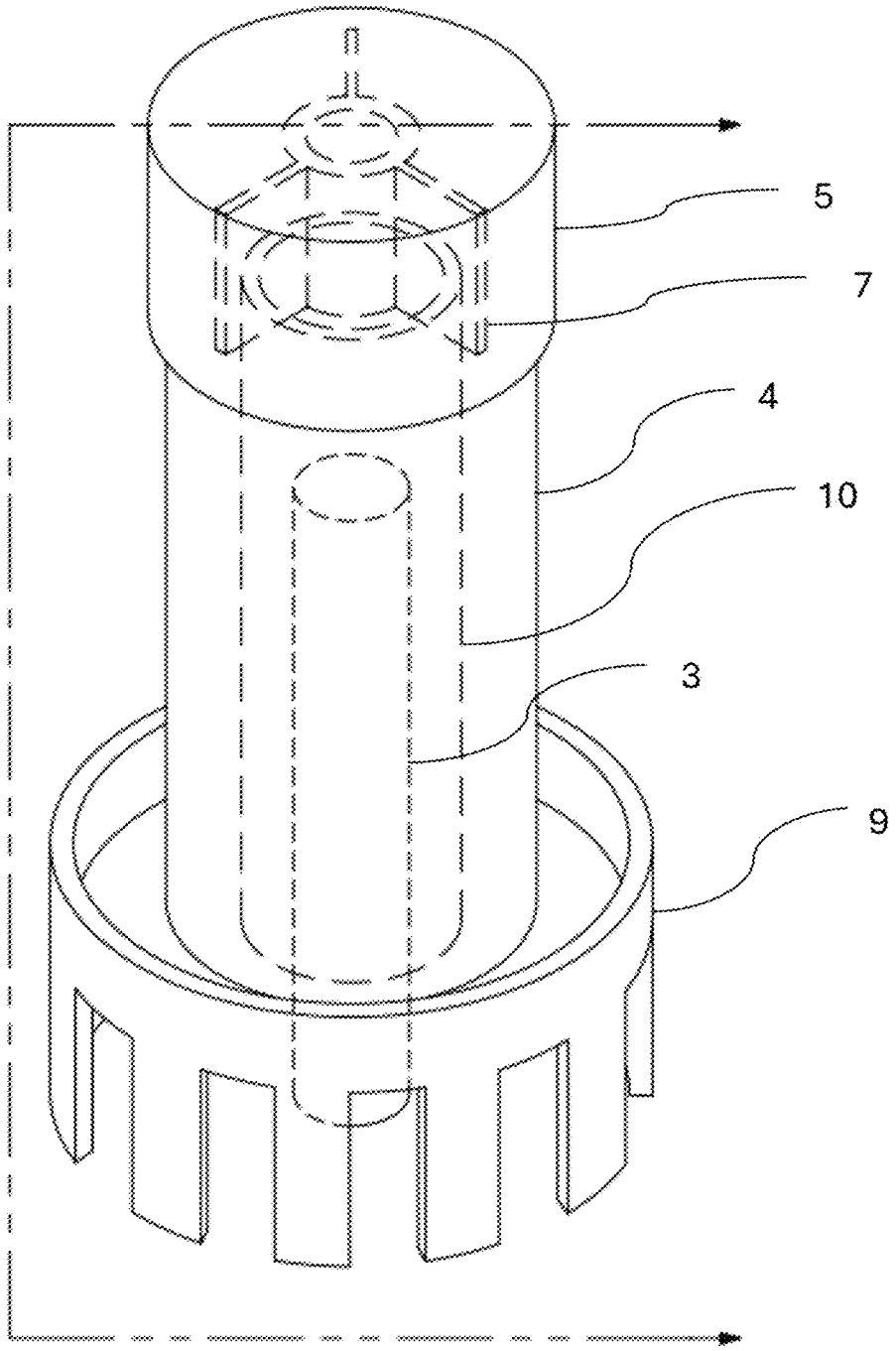
FIG. 6 is an isometric view of the double-bell siphon with the optional cup.

FIG. 6 is an isometric view of the new double-bell siphon with the optional cup 9. The spacer 7 keeps the cap from resting directly on top of the inner bell 10. The spacer 7 has one or more apertures which allow air to travel directly to the top of the inner bell and break the siphon. The inner bell 10 rests on the cup 9. When using a cup 9, the inner bell 10 does not require openings in the perimeter at the bottom as in FIG. 5 because water is able to flow up into the inner bell 10 through an opening in the cup. The cup 9 must have one or more openings in its base to allow fluids to enter the base and flow up into the inner bell 10.

The purpose of the optional cup 9 is to separate a select volume of water from the rest of the tank. As the water level drops below the lip of this cup, the water inside the cup separates from the entire liquid reservoir. This creates a set volume of water that once siphoned through the outer bell cannot be replaced by water from the reservoir. This means that the siphon will more reliably stop.

PVC plastic is the recommended material for the bells. Although any engineer or designer with proper resources could create a bell siphon in another plastic, such as CPVC or acrylic, or metal, we built the bells with Schedule 40 PVC. The spacer 7 and the cup 9 may be 3D-printed out of PLA, ABS, or other plastic.

Figure 7:
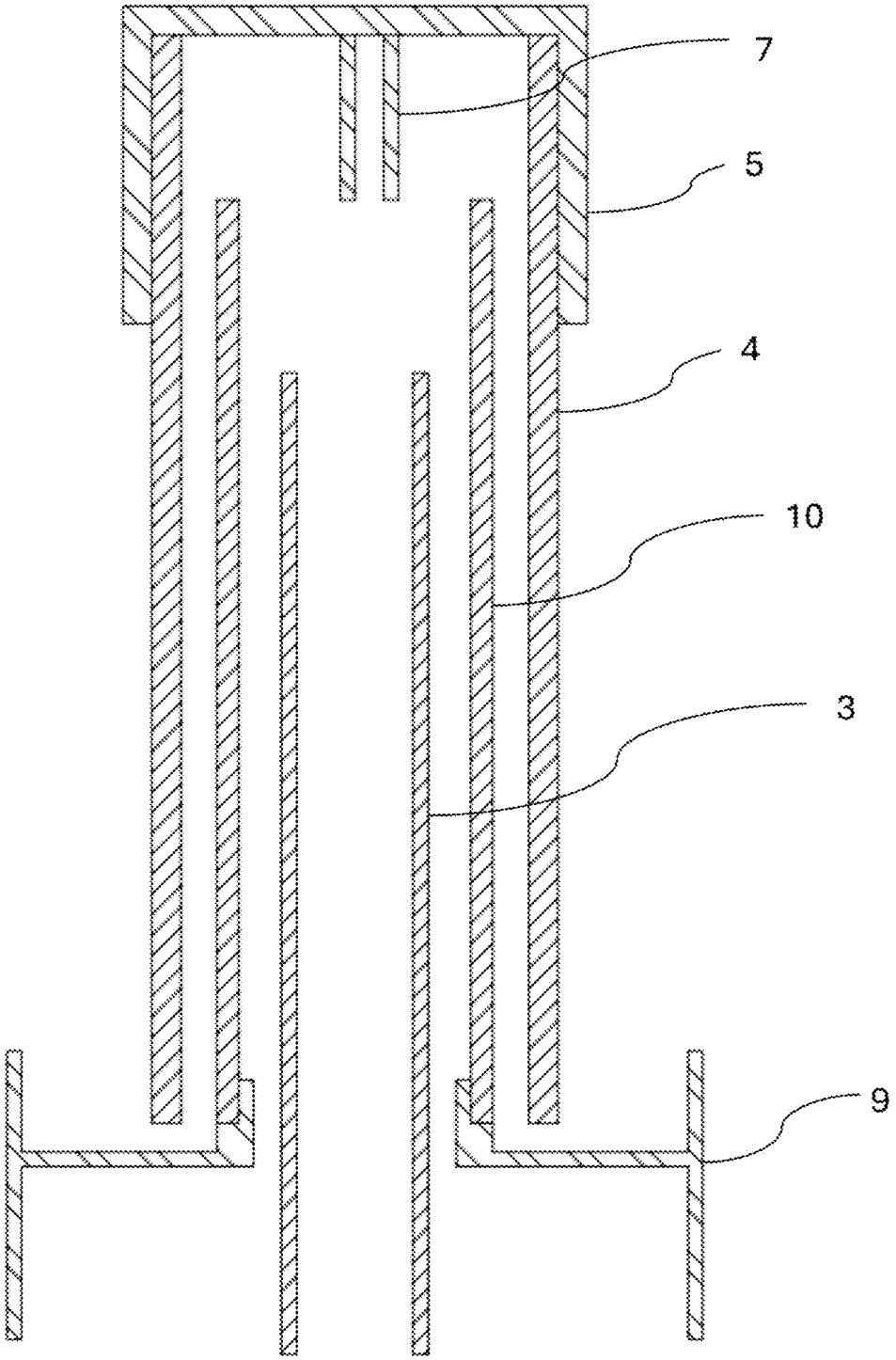
FIG. 7 is a cross-sectional view of the double-bell siphon.

FIG. 7 is a cross-sectional view of the double-bell siphon design depicted in FIG. 6.

Figure 8:
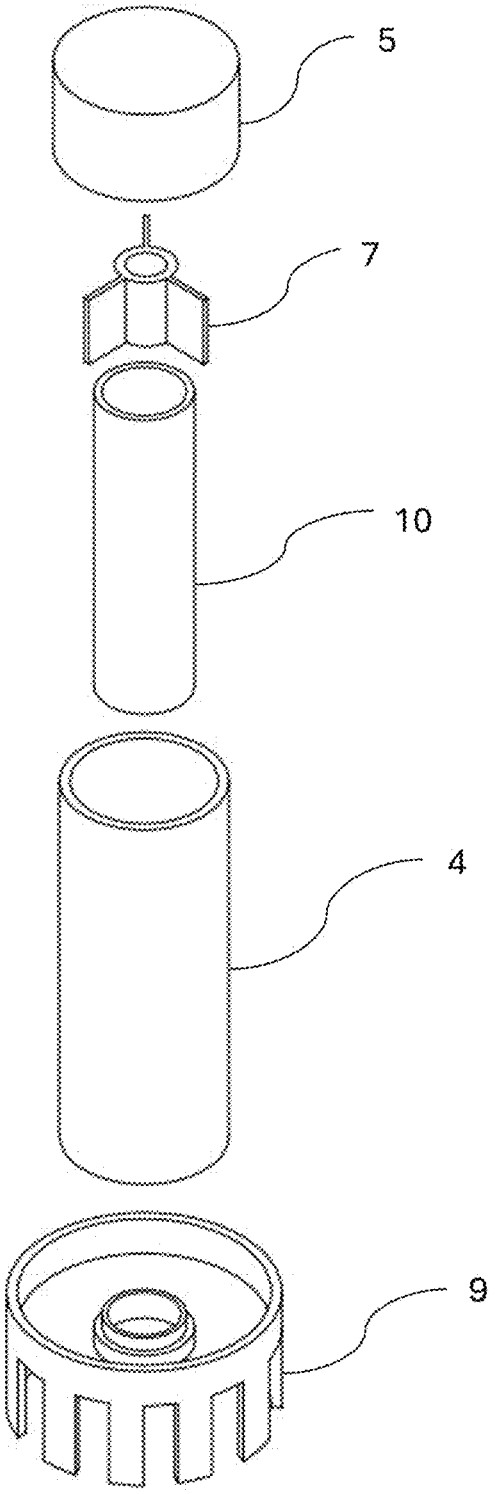
FIG. 8 is an exploded view of the double-bell structure with the optional cup. The standpipe is omitted from this drawing.

FIG. 8 is an exploded view of the double-bell structure. The standpipe is omitted from this drawing.

We claim:

1. An automatic double-bell siphon, comprising:

a. a standpipe installed in a floor of a liquid reservoir;

b. an inner bell consisting of a single unitary conduit that abuts the floor of the liquid reservoir and surrounds said standpipe with an annular space between said inner bell and said standpipe and which has an opening at a top end for fluids to enter and one or more openings at a bottom end for fluids to enter, wherein said one or more openings pass through a wall of the bottom end;

c. an outer bell closed at a top end and open at a bottom end which covers and surrounds said inner bell with an annular space between said outer bell and said inner bell and which provides a channel for fluids to flow from a surrounding liquid reservoir into said inner bell.

2. The automatic bell siphon of claim 1, wherein said outer bell is mounted on top of said inner bell with a spacer abutting a top of said inner bell and abutting and supporting an inner surface of a cap connected to said outer bell.

3. An automatic double-bell siphon, comprising:

a. a standpipe installed in a floor of a liquid reservoir;

b. a cup that abuts the floor of the liquid reservoir and surrounds said outer belt said standpipe with an annular space between said cup and said standpipe and which has one or more openings in a base of the cup to allow fluids from the liquid reservoir to enter the base of the cup;

c. an inner bell consisting of a single unitary conduit that abuts the cup and surrounds said standpipe with an annular space between said inner bell and said standpipe and which has an opening at a top end for fluids to enter and one or more openings at a bottom end for fluids from below the cup to enter said inner bell;

d. an outer bell closed at a top end and open at a bottom end which covers and surrounds said inner bell with an inner annular space between said outer bell and said inner bell and wherein said outer bell is surrounded by said cup with an outer annular space between said outer bell and said cup and wherein said outer annular space provides a channel for fluids to flow from said cup into said outer bell.

4. The automatic bell siphon of claim 3, wherein said outer bell is mounted on top of said inner bell with a spacer abutting a top of said inner bell and abutting and supporting an inner surface of a cap connected to said outer bell.

* * * * *